United States Patent [19]

Kueny

[11] 4,094,279

[45] June 13, 1978

[54] DUCTILE IRON ROLLER TAPPET BODY AND METHOD FOR MAKING SAME

[75] Inventor: Kenneth E. Kueny, North Muskegon, Mich.

[73] Assignee: Johnson Products Div. of Sealed Power Corporation, Muskegon, Mich.

[21] Appl. No.: 684,250

[22] Filed: May 7, 1976

[51] Int. Cl.[2] ..... F01L 1/14

[52] U.S. Cl. ..... 123/90.51

[58] Field of Search ..... 123/90.51, 90.5

[56] References Cited

U.S. PATENT DOCUMENTS

| | | | |
|---|---|---|---|
| 1,528,675 | 3/1925 | Libbey | 123/90.51 |
| 1,551,631 | 9/1925 | Bartlett | 123/90.51 |
| 1,582,883 | 4/1926 | Rich | 123/90.51 |
| 1,649,409 | 11/1927 | Jardine | 123/90.51 |
| 2,682,863 | 7/1954 | Line | 123/90.51 |
| 2,963,011 | 12/1960 | Davis | 123/90.51 |
| 3,122,822 | 3/1964 | Kueny | 123/90.51 |
| 3,124,869 | 3/1964 | Behnke | 123/90.51 |
| 3,149,410 | 9/1964 | Dornbos | 123/90.51 |
| 3,412,721 | 11/1968 | Thompson | 123/90.51 |
| 3,690,959 | 9/1972 | Thompson | 123/90.51 |

*Primary Examiner*—Charles J. Myhre
*Assistant Examiner*—Jeffrey L. Yates
*Attorney, Agent, or Firm*—Price, Heneveld, Huizenga & Cooper

[57] ABSTRACT

A roller tappet includes a central valve lifter body having a bifurcated end. A roller is supported at the bifurcated end and adapted for engagement by the lobes of a cam shaft. The valve lifter body reciprocates within a cylindrical bore defined by a cast iron engine block. The roller tappet body is formed from a ductile iron material thereby decreasing side wall wear and substantially eliminating galling between the valve lifter body and the wall of the cast iron tappet bore.

6 Claims, 1 Drawing Figure

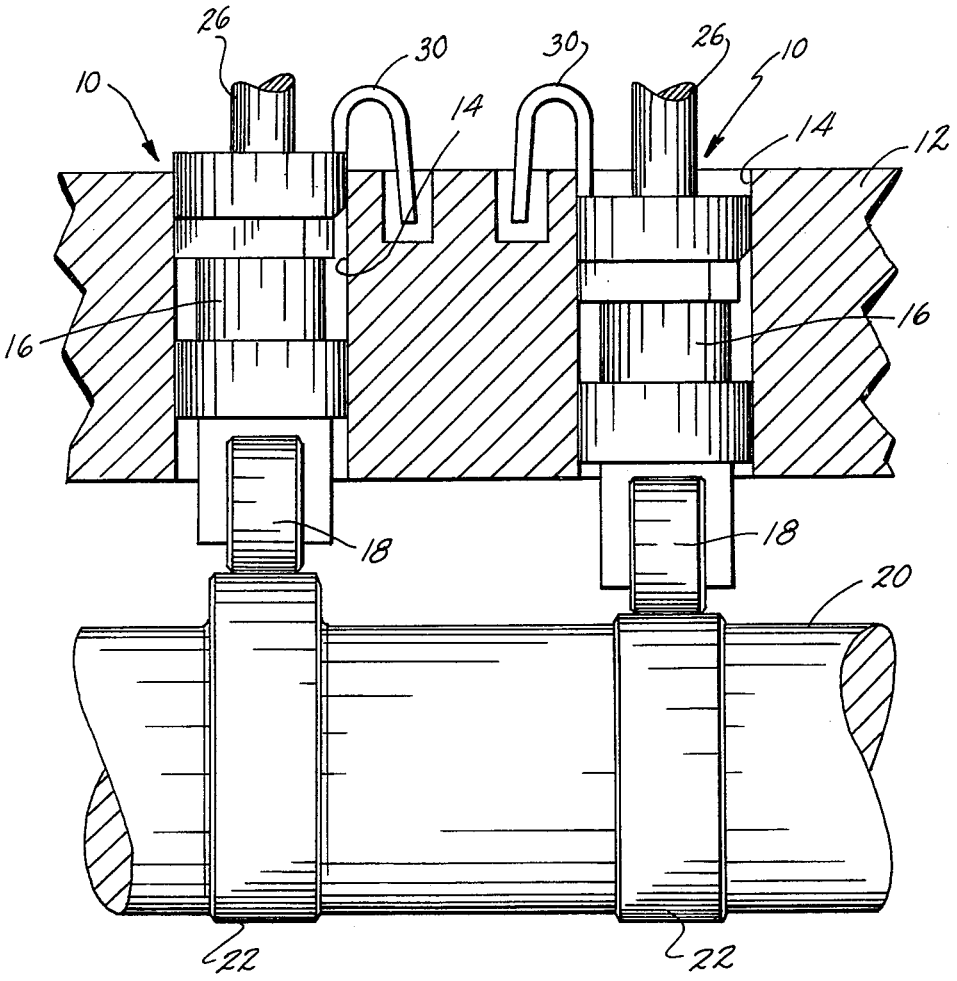
26
30
30
26
10
10
14
14
12
16
16
18
18
20
22
22

DUCTILE IRON ROLLER TAPPET BODY AND METHOD FOR MAKING SAME

BACKGROUND OF THE INVENTION

This invention relates to roller tappets of the type including a central valve lifter body having a bifurcated end for support of a roller. The roller tappet is adapted for placement within a cast iron roller tappet bore defined by an engine block and the roller is engaged by cam lobes formed on a cam shaft.

Roller tappets have been employed to increase engine breathing since they allow increased lift velocity without an increase in the tappet body diameter. Conventionally, roller tappets include a central valve lifter body portion having a bifurcated end in which the roller is mounted. The roller tappet body reciprocates in a bore formed in the engine block. The roller tappet bore is dimensioned to provide sufficient guide surface area for proper operation of the tappet.

Conventional, non-roller hydraulic tappets are normally fabricated from hardenable or chilled gray iron. These materials are not strong enough for use with roller tappets. The legs of the bifurcated end which supports the roller when formed from these materials will not withstand loads imposed on them during operation. As a result, the industry has universally specified SAE 1144 steel having a tensile strength of approximately 130,000 PSI in the fabrication of roller tappets. SAE 1144 steel has been felt to be the material having sufficient strength and wearability to provide the roller tappets with an adequate service life.

Although these prior roller tappet constructions having a valve lifter body fabricated from steel have generally been acceptable, several problems have been encountered. For example, when used in an engine block formed from cast iron, side wall and guide surface wear have been experienced. Further, the steel tappet bodies have a tendency to gall or chafe within the cast iron roller tappet bores. This wear and galling increase the tolerances and result in improper tappet operation.

SUMMARY OF THE INVENTION

In accordance with the present invention, a unique roller tappet is provided whereby the problems heretofore experienced with conventional steel roller tappets are substantially eliminated. Essentially, the improved roller tappet construction includes a central valve lifter body fabricated from a ductile or nodular iron. In narrower aspects, the ductile iron roller tappet is provided with a tensile strength of approximately 80,000 PSI. In the preferred form the tappet is composed of 3.20 to 4.10% carbon; 1.80 to 2.80% silicon; up to 0.80% manganese; 0.10% maximum phosphorous; 0.03% maximum sulfur; up to 0.10% magnesium; and the remainder being iron.

The improved roller tappet provides a synergistic compatibility with a cast iron engine block thereby eliminating the heretofore experienced wear and galling problems. Further, fabrication from ductile iron results in substantial manufacturing advantages including increased tool life, reduced chip size, increased feed rates, and increased ease of machinability when compared with SAE 1144 steel fabrication.

BRIEF DESCRIPTION OF THE DRAWING

The single drawing is a fragmentary sectional view illustrating a pair of roller tappets operably mounted in an internal combustion engine.

DETAILED DESCRIPTION OF THE PREFERRED EMBODIMENT

The single drawing illustrates a typical roller tappet 10 installed in an internal combustion engine having a cast iron cylinder block 12. The cylinder block 12 defines a plurality of cylindrical, cast iron tappet bores 14. The roller tappets 10 are disposed within each cast iron tappet bore for reciprocating motion. Each roller tappet 10 includes a central valve lifter body 16. The valve lifter body 16 defines a surface which mates with a guide surface defined by the wall of each cast iron tappet bore 14. The lower end of the valve lifter body 16 is bifurcated and a roller 18 is rotatably mounted by a shaft within the bifurcated end. A cam shaft 20 is rotatably mounted in the engine and includes a plurality of cam lobes 22. Each cam lobe 22 engages each roller to thereby reciprocate the roller tappets within the cast iron tappet bores. The roller tappets in turn engage push rods 26 in the conventional manner.

The valve lifter bodies 16 illustrated in the drawing are shown as being of spool-like configuration and employing a one-piece valve lifter guide or retaining clip 30. The operation of this particular form of roller tappet is more fully set forth in U.S. Pat. No. 3,795,229.

Roller tappets in accordance with the present invention may differ in shape from that shown in the drawing. For example, the tappet disclosed in commonly owned U.S. patent application, Ser. No. 517,042, filed Oct. 23, 1974, entitled Improved Roller Tappet, now U.S. Pat. No. 3,977,370 may also be fabricated according to the present invention.

All of these prior roller tappet structures have been fabricated from steel, such as SAE 1144 steel. Such steel material has a tensile strength of approximately 130,000 PSI and a general chemical composition of 0.040 to 0.48% carbon; 1.35 to 1.65% manganese; 0.04% of maximum phosphorous; 0.24 to 0.33% sulfur and the remainder being iron. Fabricating the central valve lifter body from this material has several disadvantages. First of all, the SAE 1144 steel is generally provided to the roller tappet manufacturer in the form of bar stock. Very often the bar stock is produced with a seam which results in machining difficulties and defective parts. Further, all of these valve lifter bodies, primarily due to material incompatibility, suffer from high side wall wear rates as well as galling when mated with the softer, cast iron tappet bore walls. The industry has felt that the use of high tensile strength steel was necessary to obtain sufficient strength for reliability.

The roller tappet in accordance with the preferred form of the present invention, however, includes a central valve lifter body fabricated from a nodular or ductile iron material. The ductile iron material is more compatible with the cast iron engine block and substantially eliminates the side wall wearing problems and galling heretofore experienced with conventional tappet bodies formed from SAE 1144 steel. The preferred ductile iron for fabricating the valve lifter body 16 has a tensile strength of approximately 80,000 PSI. Such a ductile iron valve lifter body has sufficient strength to provide the desired reliability and service life. The preferred chemical composition of the nodular or ductile iron is 3.20 to 4.10% total carbon; 1.80 to 2.80% silicon; up to 0.80% manganese; 0.10% maximum phosphorous; 0.03% maximum sulfur; up to 0.10% magnesium and the remainder being iron.

It is believed that the improved performance of the ductile iron roller tappet over a roller tappet made from SAE 1144 steel is the result of the microstructure of the ductile iron material. The ductile or nodular cast iron is produced by adding graphite spherulitic alloys such as magnesium to the molten iron. These additions cause graphite to form into small nodules which results in a higher strength, ductile iron. The nodular graphite, pearlite and some ferrite in the ductile iron microstructure makes it very compatible with the cast iron tappet bores of the engine block. By contrast, the microstructure of SAE 1144 steel contains no graphite. Since graphite which is a built-in lubricant is not present, such SAE 1144 steel roller tappets tend to gall when operating in a cast iron engine block.

Further, ductile iron bar stock is seam free which is not always the case with SAE 1144 steel bar stock. As a result, the ductile iron has better machinability characteristics. Fabricating the roller tappets from ductile iron results in better tool life, increased feed rates and speeds and corresponding increased production rates. The free machining and small chip characteristics of the ductile iron results in this material being superior from a machinability standpoint than SAE 1144 steel.

The unique roller tappet in accordance with the present invention may be cast or machined from ductile iron bar stock, as stated above. The body could be further hardened to increase the tensile strength and wearability although this hardening step is not felt to be necessary.

The above description should be considered as that of the preferred embodiment only. The true spirit and scope of the present invention will be determined by reference to the appended claims.

The embodiments of the invention in which an exclusive property or privilege is claimed are defined as follows:

1. In a roller tappet of the type including a central valve lifter body having a bifurcated end supporting a roller, the body being adapted for reciprocating movement within a bore formed in a cast iron engine block, wherein the improvement comprises:

said body being formed from nodular iron.

2. The improvement as defined by claim 1 wherein said nodular iron body has a tensile strength of approximately 80,000 PSI.

3. The improvement as defined by claim 1 wherein said nodular iron body is comprised of 3.20 to 4.10% carbon; 1.80 to 2.80% silicon; up to 0.80% manganese; 0.01% maximum phosphorous; 0.03% maximum sulfur; up to 0.10% magnesium and the remaining portion being iron.

4. A method of fabricating an improved roller tappet having a valve lifter body for use in cast iron engine blocks, comprising the step of:

fabricating said valve lifter body from nodular iron.

5. The method as defined by claim 4 wherein said nodular iron has a tensile strength of at least 80,000 PSI.

6. The method as defined by claim 4 wherein said nodular iron consists essentially of 3.20 to 4.10% carbon; 1.80 to 2.80% silicon; up to 0.80% manganese; 0.10% maximum content of phosphorous; 0.03% maximum content of sulfur; up to 0.10% magnesium and the remainder being iron.

* * * * *

UNITED STATES PATENT AND TRADEMARK OFFICE

CERTIFICATE OF CORRECTION

PATENT NO. : 4,094,279

DATED : June 13, 1978

INVENTOR(S) : Kenneth E. Kueny

It is certified that error appears in the above-identified patent and that said Letters Patent are hereby corrected as shown below:

Column 2, line 41:
"0.040" should be --0.40%--

Column 4, line 20:
"0.01%" should be --0.10%--

Signed and Sealed this

*Sixth* Day of *February 1979*

[SEAL]

*Attest:*

RUTH C. MASON
*Attesting Officer*

DONALD W. BANNER
*Commissioner of Patents and Trademarks*